US006850166B2

(12) United States Patent
Deeds

(10) Patent No.: US 6,850,166 B2
(45) Date of Patent: Feb. 1, 2005

(54) ANCILLARY WIRELESS DETECTOR

(75) Inventor: Douglas Deeds, Forth Worth, TX (US)

(73) Assignee: Nokia Mobile Phones Limited, Espoo (FI)

( * ) Notice: Subject to any disclaimer, the term of this patent is extended or adjusted under 35 U.S.C. 154(b) by 575 days.

(21) Appl. No.: 09/894,493

(22) Filed: Jun. 28, 2001

(65) Prior Publication Data

US 2003/0001741 A1 Jan. 2, 2003

(51) Int. Cl.[7] ..... G08B 21/00

(52) U.S. Cl. ..... 340/635; 340/644; 340/658; 340/691.6; 455/67.1; 455/67.7; 455/226.1; 455/226.4; 455/115

(58) Field of Search ..... 340/635, 641, 340/658, 691.6; 455/67.1, 67.7, 226.1, 226.4, 115

(56) References Cited

U.S. PATENT DOCUMENTS 5,149,317 A * 9/1992 Robinson ..... 600/27
5,281,957 A * 1/1994 Schoolman ..... 345/8
5,409,445 A * 4/1995 Rubins ..... 600/27
5,848,362 A 12/1998 Yamashita
6,078,660 A * 6/2000 Burgress ..... 379/386
6,085,428 A * 7/2000 Casby et al. ..... 33/286
6,223,059 B1 4/2001 Haestrup
6,240,392 B1 * 5/2001 Butnaru et al. ..... 704/271
6,244,703 B1 * 6/2001 Resnikoff et al. ..... 351/44

OTHER PUBLICATIONS

PLANTRONICS—World Leader in Communications Headsets; M1000–The Key to Bluetooth Communications; 2 pp.; Santa Cruz, California 96050 USA.

An Introduction To GSM; Siegmund M. Redl, Matthias K. Weber, Malcolm W. Oliphant; Artech House; Chapter 9—Testing A GSM Mobile Station.

* cited by examiner

*Primary Examiner*—Daniel J. Wu
*Assistant Examiner*—Tai T. Nguyen
(74) *Attorney, Agent, or Firm*—Robert C. Rolnik

(57) ABSTRACT

Disclosed is a stimuli providing indicator (107) that is responsive to nearby transmitted radio signals. Fixed and mobile stations may produce such signals. In addition a cellular telephone operating at a high transmit power may be detected. Indicator (107) may be supported by a lens (103) which itself may be supported by at least one head mount (101).

15 Claims, 1 Drawing Sheet

ANCILLARY WIRELESS DETECTOR

BACKGROUND

The invention relates to radio frequency detection, and more particularly to signaling to a user the presence of radio frequency output of a mobile station, among other wireless transmitters.

U.S. Pat. No. 6,190,227 describes, "An incoming call reporting toy that visually or au rally reports a call arrival state of a portable terminal to a person around the toy in an amusing fashion. An electromagnetic wave emitted when a portable terminal receives an incoming call is used to activate an incoming call reporting circuit incorporated in the toy body. A signal outputted from a signal controller configuring the incoming call reporting circuit drives a motor to allow the toy body to perform a predetermined operation while emitting a sound and/or light, thereby notifying a person around the toy of the arrival of the call at the portable terminal."

A product brochure for a Plantronics M1000 Headset states, "We've used our 40 years of headset experience to engineer and design the ultimate Bluetooth headset. Using a second-generation Bluetooth chipset, the M1000 Wireless Headset offers superior sound quality, longer talk time, superb comfort and stability, weighing less than an ounce . . . Key Features . . . In-use indicator light."

Lenses have been used in many different forms for centuries. A lens may have refractive qualities that provide correction for poor vision. A lens includes such transparent devices as windshields of motorcycle helmets, transparent glass or plastic of diving masks, and goggles worn to keep out dust, debris and other particles.

When a mobile station is set to silent or vibrate mode, frequently the only way to be aware of an incoming call is to observe changes on the display of the mobile station. A mobile station that is stowed away, or otherwise out of sight will have no way to communicate, under these circumstances, that a call has arrived. Sometimes this serves a valid purpose, i.e. avoiding disturbing others nearby who are concentrating on other things. Sometimes, though, it is acceptable to take the call, but not acceptable for disturbing rings and other audible stimuli to occur. Thus, it would be helpful to improve awareness of mobile station status in a highly visible or other way, preferably without the need to be tethered to the mobile station.

SUMMARY

A wireless communication reporter embodiment may receive a wireless signal and by way of a radio frequency detection circuit, provide a signal. The signal may be passed to a light emitter or other indicator which is supported by the head mount. Thus the combined apparatus may be worn on the head of a user.

An advantage of the embodiment is that it may detect signals transmitted by a mobile station for relatively private awareness and sensing by the user.

BRIEF DESCRIPTION OF THE DRAWINGS

The present invention is further described in the detailed description which follows in reference to the noted plurality of drawings by way of non-limiting examples of preferred embodiments of the present invention in which like reference numerals represent similar parts throughout the several views of the drawings and wherein.

DETAILED DESCRIPTION

A head mount may be any head worn or supported device that is not, under normal circumstances, sufficiently transparent for images to pass through and be discernable by a human being having good or poor eyesight. A head mount may be adapted to receive a lens. A lens may be a sufficiently transparent material suitable for images to pass through and be discernable by a human being having good or poor eyesight, wherein such lens is sufficiently small to be supported on a person's head by, e.g. a head mount. A head mount may be head worn or supported in the most broad sense that the head includes all human body parts above the neck, and that support may be of a temporary nature of a few minutes or a more permanent nature, lasting for months.

One such head mount is a frame for eyeglasses. One such lens may be a plastic, glass or other translucent material that is ground, polished and shaped to fit in the frame. A head mount may have many parts, for example a typical eyeglass frame comprises a first arm, a first hinge, a lens carrier, a second hinge and a second arm. A head mount may have few parts, for example laboratory safety goggles may be comprised of a semi-rigid facemask and an elastic band used to encircle the head.

One or more lenses may be supported by multiple head mounts. For example, a first arm may be affixed to a first lens. The first lens may be affixed to a bridge. The bridge may be affixed to a second lens. The second lens may be affixed to a second arm. In this situation, the first arm, bridge and second arm are all head mounts.

A lens must, in its head-worn configuration, be predominantly unobstructed by opaque foreign objects supported by the head mount, including parts of the head mount, while being worn.

Figure 1:
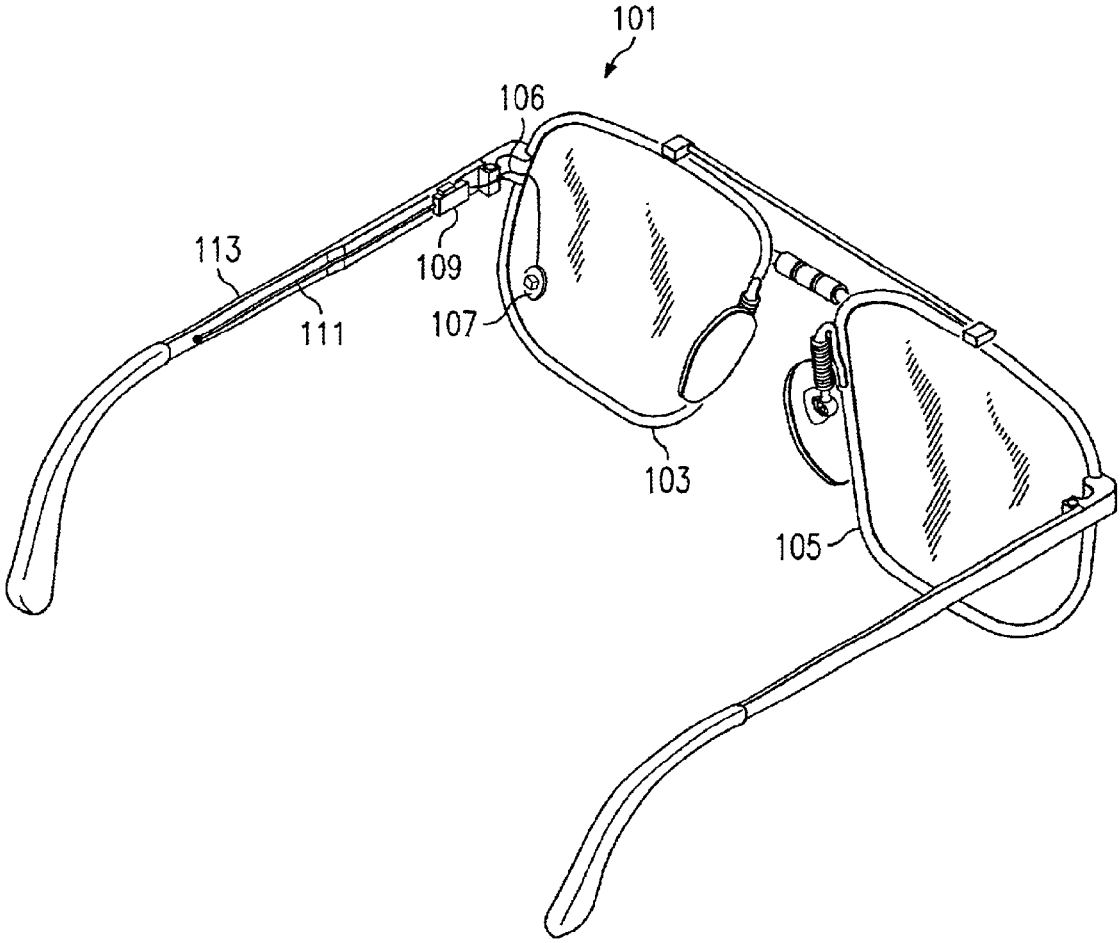
FIG. 1 is a view of a wireless communication reporter embodiment having a light emitter.

FIG. 1 shows a head mount 101, with a left lens 103 and a right lens 105 according to an wireless communication reporter embodiment. A source of stimulus or indicator, such as a light emitter 107, may occupy a minute fraction of the visible area of the left lens 103. The light emitter 107 is coupled to a radio frequency detection circuit 109 (RFDC). As an option, RFDC 109 may include a photocell, which may provide a reading of ambient light levels and adjust current to the light emitter 107 to provide higher intensity light when ambient light is high, and lower intensity light when ambient light is low. Light emitter 107 may flash, e.g. on a duty cycle long enough not to be annoying to the person wearing the device. A range for the RFDC 109 may be extended by providing an antenna 111 along an arm 109 of the head mount 101.

Figure 2:
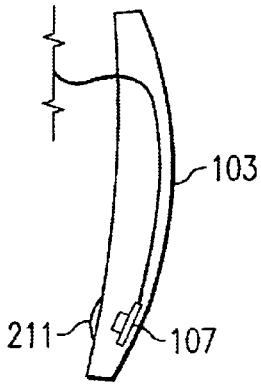
FIG. 2 is an edge-wise view of a lens portion of an embodiment.

FIG. 2 shows a lens 103 that provides a diffuser 211 which may enhance visibility of the light emitter 107.

Because the indicator is so close to a user's eyes, ears and skin, only a very low level stimulus may be required for people of ordinary sensory abilities to sense that the indicator is operating. By the same token, a higher level of stimulus may be required in situations where there is ambient noise or light that might otherwise drown out such stimulus. Disease, injury, age, intoxication and other awareness factors may impact the ability of a user to be aware of a stimulus, however a reasonable level of stimulus for most situations may be that which most people who use prescription glasses can see under normal daylight circumstances.

FIG. 1 shows the light source or light emitter 107 coupled to the indicator output 106 and operative based on the indicator output 106, the light source having an anisotropic output directed along at least one ray or principal ray, wherein the at least one ray points in a direction of the user. The light or light emitter may be any combination of radiating means combined with reflectors, shades and focussing lenses as are known in the art. A suitable light emitter may be a light emitting diode. The light or light emitter may initially transmit light in several directions, however, after any intervening reflectors, shades or lenses, very little or no light may pass in a direction away from a user wearing the embodiment.

Radio frequency detection circuit (RFDC) 109 may be tuned to at least one cellular frequency band, which may, preferably be an uplink channel, e.g. a signaling channel selected from frequencies in an uplink signaling band of a cellular telephone. Cellular telephones are known to respond to communications transmitted from a base station on a cellular band. The cellular telephone may respond using an uplink signaling channel which is a type of cellular band radio signal. The power level for such a radio frequency response is often set by national and international standards. Thus, the effective radiative power (ERP) of a cellular telephone transmitter in good working order, is within a known tolerance of effective radiative power set for the cellular regime in which the cellular phone operates. There is less variability between manufacturers in the radio frequency band licensed for cellular. However, for transmissions that are outside the licensed band, or that are inside the licensed band, but in a roll-off region of unintended but unavoidably transmitted frequencies, the ERP may vary over a greater range of levels, despite a common distance from transmitting cellular telephone to RFDC. Consequently, it may be difficult to select a RFDC preset level that is equally sensitive to cellular telephones of all manufacturers.

The radio waves emitted by a cellular telephone antenna may be anisotropic, i.e. they may not radiate with uniform power in all directions. Occasionally cellular telephones and supporting antennas are built with reduced radio output in a direction, such as, e.g. toward the user of the cellular telephone when held to the head. A mobile phone may be placed in an environment with a number of obstructions that block, diffract or reflect radio frequencies in the cellular bands. Nevertheless, signals emitted by a cellular telephone generally exhibit a rapid diminution in power in relation to the inverse square of the distance a receiver is from the cellular telephone antenna.

Such a diminution in signal power is predictable to some extent, and a receive threshold, or preset level, may be established for signals that arrive from a cellular telephone that is in a locus of a person. A locus of a person may be the immediate surroundings of the person including locations in and among worn items, as well as areas within the immediate reach of a person or user's hand. A locus of a person may include a volume of space of a typical office or bedroom.

A locus of a cellular telephone is similar in concept to the locus of a person. It may be the space from which a person may occupy and reach through to immediately reach and grasp the cellular telephone. The locus of a cellular telephone may be a volume of space of a typical office or bedroom. The preset level may be set to operate to detect uplink signaling signals of the cellular telephone throughout most of the locus of the cellular telephone under most circumstances. In other words, if the radio frequency detection circuit 109 is in the locus of the cellular telephone, the preset level will be low enough to detect most uplink signaling signals of the cellular telephone. A RFDC 109 that is within the locus of a cellular telephone may, nevertheless, fail to detect a uplink signaling signal in situation where, e.g. the cellular telephone is behind a metallic wall. The RFDC 109 may be in a null, created by, e.g. Raleigh fading—thus also the RFDC 109 may fail to detect a transmitting cellular telephone. Just the same, the preset level may be set to detect a presence of a uplink signaling signal, wherein the RFDC 109 is in the locus of the cellular telephone.

The RFDC 109 may detect signals within one or more cellular bands. The RFDC 109 may be tuned to detect a sub-frequency or channel of a cellular band, e.g. a uplink signaling channel.

Similarly, a RFDC 109 may detect, on rare occasions, an uplink signaling signal from a cellular telephone that the RFDC 109 is beyond the locus of the cellular telephone. Though anomalous, such an occurrence may happen if the RFDC 109 is at a constructive interference point of multiple radio paths from the cellular telephone, or multiple cellular telephones receive a call and respond with a uplink signaling channel transmittal concurrently.

Thus, during extraordinary circumstances, where the preset level may be a locus level that corresponds to a locus of a cellular telephone, the RFDC 109 may provide a false signal when outside the locus of a cellular telephone, and may fail to provide a signal when the inside the locus of a cellular telephone. Nevertheless, for ordinary use, e.g. the embodiment worn on the head, and a cellular telephone worn or temporarily placed in a dock or on a table, the RFDC may provide a stimulus when inside the locus of a transmitting cellular telephone so-placed.

A locus level may correspond to an arms-length space which may be useful in that more remote cellular telephones may not trigger the RFDC 109. Thus, a likelihood that the cellular telephone of a neighboring user may be low. A locus level may correspond to a body-length space, which may be useful in that a cellular telephone may be placed on a table, floor or other resting place and still be capable of triggering the RFDC 109. The arms-length space is the idealized space that, absent reflections, diffractions or blocking of radio waves, an RFDC 109 found within a radius of approximately a human's arm length of the cellular telephone, will trigger a indicating signal in the RFDC. The body-length space is the idealized space that, absent reflections, diffractions or blocking of radio waves, an RFDC found within a radius of approximately a human's body length of the cellular telephone, will trigger a indicating signal.

Although the invention has been described in the context of particular embodiments, various alternative embodiments are possible. Thus, while the invention has been particularly shown and described with respect to specific embodiments thereof, it will be understood by those skilled in the art that changes in form and configuration may be made therein without departing from the scope and spirit of the invention.

What is claimed is:

1. A wireless communication reporter for wearing on a head of a user comprising:

a head mount;

a radio frequency detector circuit (RFDC) having a light emitter supported by the head mount, said radio frequency detector circuit providing a signal, said RFDC responsive to a radio frequency signal above a preset level in a uplink signaling band; and a lens supported by the head mount, wherein the light emitter or said lens illuminates in response to the signal provided by the radio frequency detector circuit.

2. The wireless communication reporter of claim 1 wherein the light emitter has an anisotropic output directed along a principal ray, wherein said ray points in a direction of the user.

3. A wireless communication reporter for wearing on a head of a user and detecting a radio signal of a radio transmitter comprising:

a head mount having a lens;

a radio frequency detector circuit having an indicator output, said radio frequency detector circuit (RFDC) supported by said head mount, wherein said radio frequency detector circuit comprises an uplink signaling band radio frequency detector; and an indicator on said lens coupled to the indicator output, wherein said indicator provides stimulus upon the radio uplink radio frequency detector circuit receiving the radio signal.

4. The wireless communication reporter of claim 3 wherein said stimulus comprises a light for illuminating responsive to a signal on the indicator output, whereby the light is predominantly directed toward the head of the user.

5. The wireless communication reporter of claim 4 wherein said head mount further comprises at least one lens.

6. A wireless communication reporter of claim 5 wherein said at least one lens is operatively coupled to said radio frequency detector circuit.

7. The wireless communication reporter of claim 6 wherein said indicator comprises a light emitting diode.

8. The wireless communication reporter of claim 7 wherein said light emitting diode emits light in a direction of the user responsive to a signal of a cellular telephone.

9. The wireless communication reporter of claim 8 wherein said light emitting diode emits little light in a direction away from the user responsive to a signal of a cellular telephone.

10. The wireless communication reporter of claim 7 further comprising a photocell coupled to the light emitting diode wherein low current is provided to the light emitting diode when ambient light is low.

11. The wireless communication reporter of claim 7 wherein the light emitting diode emits light periodically in response to a signal of a cellular telephone.

12. A wireless communication reporter for wearing on a head comprising:

a head mount comprising at least one lens;

a radio frequency detector circuit having an indicator output, said radio frequency detector circuit mounted on said head mount, wherein the radio frequency detector circuit provides a signal on the indicator output based on detecting a cellular telephone uplink signaling channel above a preset level; and a light emitter, coupled to the indicator output and operative based on said indicator output, said light emitter having an anisotropic output directed along a principal ray, wherein said ray points in a direction of the user.

13. The wireless communication reporter of claim 12 wherein the preset level comprises a locus level.

14. The wireless communication reporter of claim 13 wherein the locus level corresponds to an arms-length space.

15. The wireless communication reporter of claim 14 wherein the locus level corresponds to a body-length space.

* * * * *